US005408248A

United States Patent [19]

Crossland et al.

[11] Patent Number: 5,408,248

[45] Date of Patent: Apr. 18, 1995

[54] CO-ORDINATE ADDRESSING OF LIQUID CRYSTAL CELLS

[75] Inventors: William A. Crossland, Harlow; Martin J. Birch, Teddington, both of United Kingdom

[73] Assignee: Northern Telecom Limited, Montreal, Canada

[21] Appl. No.: 984,440

[22] PCT Filed: Sep. 10, 1991

[86] PCT No.: PCT/GB91/01535

§ 371 Date: Feb. 24, 1993

§ 102(e) Date: Feb. 24, 1993

[87] PCT Pub. No.: WO92/04708

PCT Pub. Date: Mar. 19, 1992

[30] Foreign Application Priority Data

Sep. 11, 1990 [GB] United Kingdom ..... 9019867

[51] Int. Cl.[6] ..... G09G 3/36

[52] U.S. Cl. ..... 345/96; 345/97

[58] Field of Search ..... 345/97, 96

[56] References Cited

U.S. PATENT DOCUMENTS 4,944,575 7/1990 Aigrain ..... 345/97

FOREIGN PATENT DOCUMENTS 0199361 10/1986 European Pat. Off. .
0371665 6/1990 European Pat. Off. .
90/07768 7/1990 WIPO .

*Primary Examiner*—Jeffrey Brier
*Attorney, Agent, or Firm*—Lee, Mann, Smith, McWilliams, Sweeney & Ohlson

[57] ABSTRACT

In an active back-plane co-ordinate addressed liquid crystal cell exhibiting an analogue optical response to the application of an analogue electric potential, refreshing is carried out in two sequential stages in order to avoid cumulative charge imbalance effects. In one stage the pixels are set to their required optical states using the appropriate applied potential differences, and in the other stage the pixels are set with the same potential differences, but applied the other way round.

4 Claims, 2 Drawing Sheets

CO-ORDINATE ADDRESSING OF LIQUID CRYSTAL CELLS

BACKGROUND OF THE INVENTION

This invention relates to the co-ordinate addressing of liquid crystal cells. Co-ordinate addressing of such cells can be achieved by methods in which each pixel is defined as the area of overlap between one member of a set of row electrodes on one side of the liquid crystal layer and one member of another set of column electrodes on the other side. In an alternative co-ordinate addressing method the liquid crystal is backed by 'an active back-plane' which has a co-ordinate array of electrode pads which are addressed on a co-ordinate basis within the active back-plane, and electrical stimuli are applied to the liquid crystal layer between individual members of this set of electrode pads on one side of the liquid crystal layer and a co-operating front-plane electrode on the other side of the liquid crystal layer. Generally the front-plane electrode is a single electrode, but in some instances it may be subdivided into a number of electrically distinct regions. The active back-plane may be constructed as an integrated single crystal semiconductor structure, for instance of silicon.

This invention relates in particular to the active back-plane addressing of liquid crystal cells which make an analogue optical response to the application of an analogue potential difference across the thickness of the liquid crystal layer. Examples of such analogue liquid crystal effects include the electroclinic effect in the smectic A phase of certain ferroelectric liquid crystal materials. And the distorted helix effect exhibited in certain ferroelectric liquid crystal materials exhibiting a very short helical pitch length typically in the range 0.1 to 0.2 $\mu$m.

In the electrical addressing of liquid crystal cells it is generally important to ensure that no pixels are subject to any significant long term cumulative charge imbalance that could give rise to electrolytic degradation effects within the cell In the cases of cells whose response is not polarity sensitive, long-term charge balance can often be ensured by using charge-balanced a.c. stimuli throughout, but clearly there are problems in transferring this approach to the addressing of cells whose response is polarisation sensitive because in these circumstances the application of a charge-balanced a.c. stimulus to a pixel may make it make a temporary excursion from its initial state to some other state, but is then likely to restore it once again to its initial state. The same problem is liable to be encountered in the driving of cells exhibiting an analogue response.

In the ensuing description any particular pixel of a co-ordinate array of pixels is identified by its row and column co-ordinates. Whereas in conventional usage of the terms 'row' and 'column', rows and columns are respectively identified as horizontally-extending and vertically-extending lines; in this instance these terms are employed in a wider sense that does not imply any particular orientation of the row and column lines with respect to the horizontal, but merely that the sets of row and column lines intersect each other.

SUMMARY OF THE INVENTION

According to the present invention there is provided a method of addressing a liquid crystal cell having a co-ordinate array of pixels which provide an analogue optical response to the application of an analogue potential difference, wherein each data refreshing of the cell is performed in two sequential stages in one of which the pixels are individually set by the application of potential differences which produce the required responses, and in the other of which substantially equivalent potential differences are applied, but are applied in the opposite direction.

The invention further provides a method of co-ordinate refreshing a liquid crystal cell that includes a liquid crystal layer that provides an analogue optical response to the application of an analogue potential difference across the thickness of that layer, which cell is electrically addressable using an active back-plane provided with a co-ordinate array of electrode pads on one side of the liquid crystal layer, which pads co-operate with a front-plane electrode on the other side of the liquid crystal layer to define an associated co-ordinate array of pixels within the liquid crystal layer, wherein each time the pixels of the co-ordinate array are refreshed, such refreshing is performed in two sequential stages that co-operate to preserve charge balance across each individual pixel of the array, in one of which stages the pixels have potential differences applied across them to set them into their required states and in the other of which the same individual potential differences are applied across the same individual pixels, but with the direction of application reversed.

If a particular pixel of the array, required to be set to provide a given level of analogue response, is caused to provide that response by the maintenance of a particular level of unidirectional potential difference across the thickness of the liquid crystal layer in the region which defines the pixel, then the provision of that potential difference is going to produce a degree of charge imbalance in this locality. If this imbalance is continued long enough, it is liable to accumulate to the extent that there is the risk of the onset of electrolytic degradation of the cell. This risk is avoided by adopting the two stage refreshing process of the present invention in which a stage that involves the setting up of the pixels into their required levels of analogue response is preceded or followed by a stage in which they are set up into levels for which the potential difference drives have the same magnitudes as required to produce the required levels, but the direction of application of those potential differences is reversed.

BRIEF DESCRIPTION OF THE DRAWINGS

There follows a description of a back-plane co-ordinate addressed liquid crystal device and its method of operation embodying the invention in a preferred form. The description refers to the accompanying drawings in which.

DETAILED DESCRIPTION OF THE PREFERRED EMBODIMENT

Figure 1:
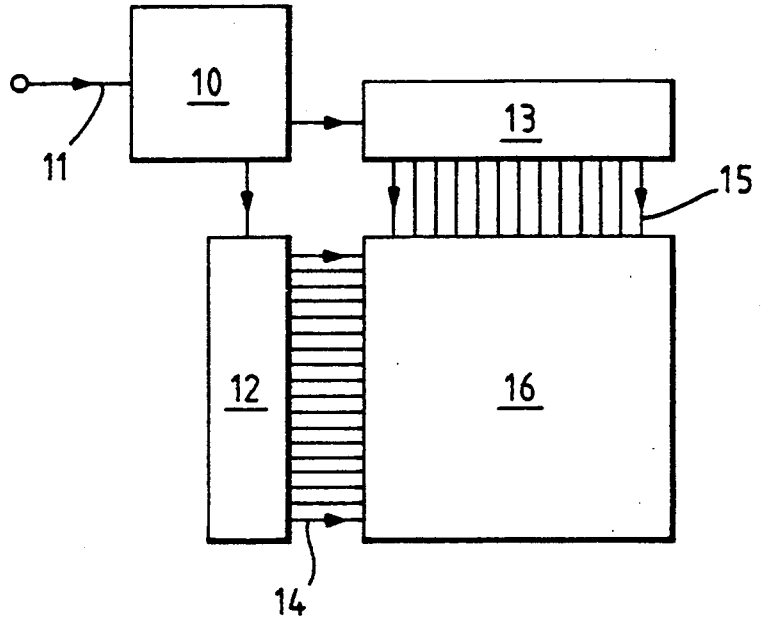
FIG. 1 is a block-diagram of a back-plane co-ordinate addressed liquid crystal device.
Figure 2:
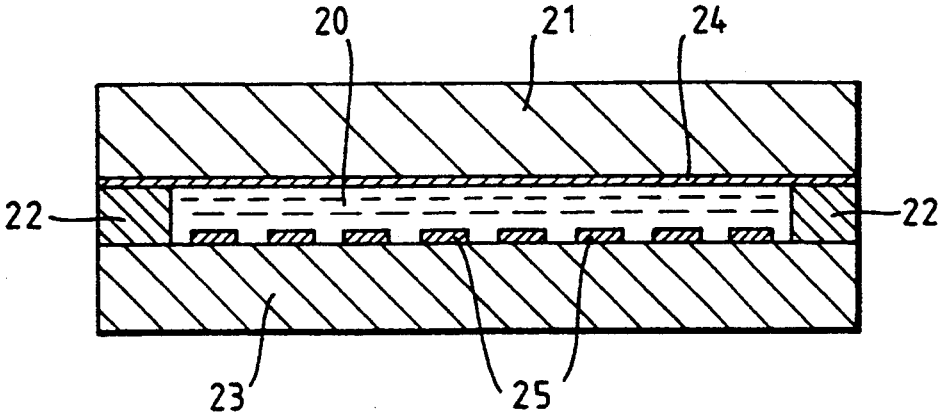
FIG. 2 depicts a schematic cross-section of the liquid crystal cell of the device of FIG. 1.

Referring to FIG. 1, a data processor 10 receives incoming data over an input line 11, and controls the operation of row and column addressing units 12 and 13 which provide inputs on lines 14 and 15 to the electrodes of a back-plane co-ordinate addressed liquid crystal cell 16 with pixels arranged in a co-ordinate array of n rows and m columns. In this cell 16 a hermetic enclosure for a liquid crystal layer 20 (FIG. 2) is formed by securing a transparent front sheet 21 with a perimeter seal 22 to a back sheet 23. Small transparent spheres (not shown) of uniform diameter may be trapped between the two sheets 21 and 23 to maintain a uniform separation, and hence uniform liquid crystal layer thickness. On its inward facing surface, the front sheet 11 carries a transparent electrode layer 24, the front-plane electrode layer, while a co-ordinate array of pixel pad electrodes 25 are similarly carried on the inward facing surface of the back sheet 23. These two inward facing surfaces are treated to promote a particular molecular alignment of the liquid crystal molecules in contact with these surfaces in the same direction. The back sheet 23 constitutes an active back-plane, by means of which the pixel pads 25 may be individually addressed on a row by row basis. Within its active structure, which may for instance be constructed in single crystal silicon, it contains the row and column addressing 12 and 13 units (FIG. 1), and may additionally contain the data processor 10. The area of overlap between the front-line electrode layer 21 and an individual pixel pad 25 defines a pixel of the cell In one example the liquid crystal layer 20 is composed of a smectic A phase of a ferroelectric smectic material exhibiting the electroclinic effect in the smectic A phase when confined between the two major surfaces of its confining envelope. In another example the liquid crystal layer 20 is a layer of short helical pitch ferroelectric liquid crystal material that exhibits the distorted helix effect when confined between the two major surfaces of its confining envelope. The cell may be viewed through a polariser (not shown) to produce a visual contrast effect, or, at least when employing the distorted helix effect, it may be employed without a polariser as a variable retardation phase object.

The application of an analogue potential difference in one direction across the thickness of the liquid crystal layer 20 will promote an analogue change of orientation of some of the liquid crystal molecules. This produces a response which typically follows a raised sinusoidal characteristic. When used as a variable contrast device the thickness of the layer is equal to an odd number of quarter wavelengths divided by the birefringence of the liquid crystal material, and is viewed through a polariser (not shown) whose orientation with respect to the surface alignment direction can be chosen so that the zero potential difference operating point lies at a maximum or minimum of the characteristic. Under these circumstances a reversal of the potential difference will produce the same response, and so the intended optical response is provided with both stages of the refreshing. A disadvantage of this approach is that the gradient of the characteristic approaches zero at the zero potential difference point, and hence the sensitivity is small in this region. An alternative operating point is one in which the polariser orientation is chosen to provide a zero potential difference operating point not far removed from the region of the characteristic at which the gradient approaches its maximum value. Under these conditions a relatively large range of grey scale values can be provided for relatively small differences in applied potential difference.

Figure 3:
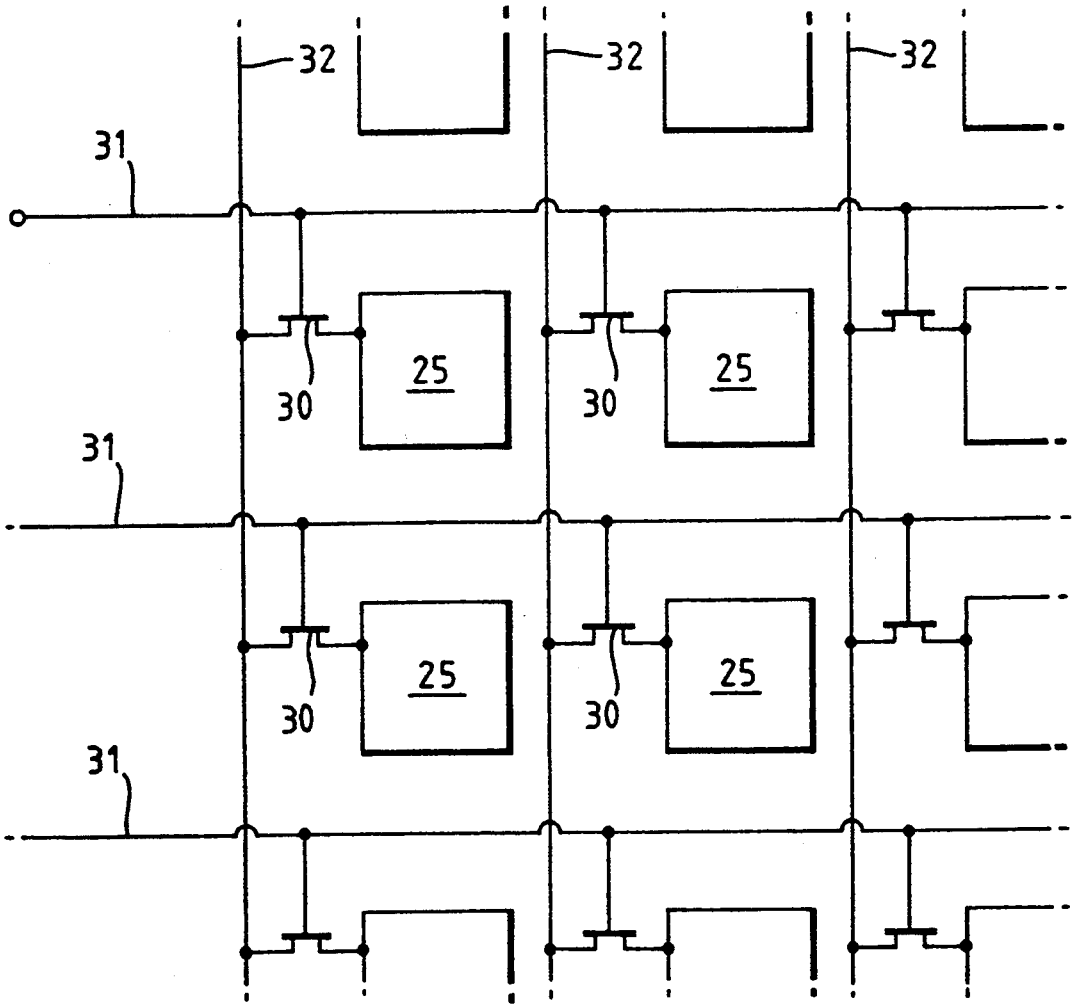
FIG. 3 is a diagram of the pixel pad addressing arrangement.

Referring now to FIG. 3, 8 single gate 30 is associated with each pixel electrode pad 25. All the m gates of a row of pixel electrode pads are enabled by the application of a suitable potential to a row electrode 31 associated with that row. The gates 30 are enabled in row sequence using a strobing pulse applied in turn to the n row electrodes 31 from the row addressing unit 12. Enablement of each row of gates 30 serves to connect each pixel electrode pad of that row with an associated column electrode 32 connected to the column addressing unit 13.

Refresh rows of data are entered in digital form in row sequence into a multi-bit m-stage shift register (not separately illustrated) in the column address unit 13 under the control of the data processor 10. Associated with each stage of the shift register is digital-to-analogue converter (not separately illustrated) which provides an analogue output for application to the associated column electrode 32 in accordance with the digital code currently held in that stage of the shift register. While the refresh line of data is stored in the shift register, the data processor 10 causes the row address unit to supply a strobe pulse to the relevant row electrode 31. This temporarily enables the gates 30 of that row so that its pixel electrode pads are charged to the various potentials supplied by the digital-to-analogue converters to the different column electrodes 32. At the end of the strobe pulse the gates 30 are returned to their disabled condition and hence, neglecting leakage effects, these potentials remain upon the pads until these gates are once again enabled. Since the potentials remain on the pads, the duration of a strobe pulse needs only to be long enough to allow the pads to become charged to their requisite potentials, and does not need to be maintained for generally significantly longer period that is required to produce the necessary optical response in the liquid crystal.

When all the rows of the array have been refreshed, and sufficient time has elapsed since the strobing of the last row to enable its pixels to have responded, the cell is ready to be observed, and the first stage of the refreshing has been completed. The second stage is a repetition of the first stage, but with 'modified' data for each row being entered from the data processor 10 into the shift register. The 'modified' data is such as to cause each digital-to-analogue converter to provide a 'modified' voltage output that for the second stage accessing of each pixel is the same amount above the potential of the front-plane electrode as it was beneath that potential in the first stage accessing of that pixel. Thus though pixels in different rows have different potentials applied across them, and for different periods of time according to how high up or low down they are in the strobing sequence, each individual pixel is subjected to a potential difference for a certain period of time special to that row, first in one direction, and then later, for an equal period of time, to an equivalent oppositely directed potential difference. At the end of the second stage of refreshing a new cycle of refreshing is immediately commenced, or alternatively all the pixel electrode pads 25 are discharged to the potential of the front-plane electrode 24. It will be apparent that it is equally valid to enter the 'modified' data in the first stage of the refreshing, rather than the second, always provided that the data providing the required analogue levels are entered in the second stage rather than the first.

One particular application for these back-plane co-ordinate addressed liquid crystal devices is as the active element of a matrix vector multiplier. In such a matrix vector multiplier a columnar array of n optical sources is optically arranged relative to the pixels of the co-ordinate array of the cell so that the $p^{th}$ element of the column of sources is optically coupled with all m pixels of the $p^{th}$ row of the co-ordinate array, while similarly a row array of m optical detectors is optically arranged relative to the pixels so that all n pixels of the $r^{th}$ column of the co-ordinate array are optically coupled with the $r^{th}$ element of the row of detectors. Conveniently a polarisation beam splitter is employed in the optical coupling of the sources and detectors with the co-ordinate array in order to provide the dual function of separating the input and output beams and of providing a polariser for the device.

We claim:

1. A method of addressing a liquid crystal cell having a co-ordinate array of pixels which provide an analogue optical response to the application of an analogue potential difference, which analogue response to applied potential difference is dependent upon the polarity of said potential difference, wherein each data refreshing of the cell is performed in two sequential stages in one of which the pixels are individually set by the application of potential differences which produce the required responses, and in the other of which substantially equivalent potential differences are applied, but are applied in the opposite direction.

2. A method of co-ordinate refreshing a liquid crystal cell that includes a liquid crystal layer that provides an analogue optical response to the application of an analogue optical response to the application of an analogue potential difference across the thickness of that layer, which analogue response to applied potential difference is dependent upon the polarity of said potential difference, which cell is electrically addressable using an active back-plane provided with a co-ordinate array of electrode pads on one side of the liquid crystal layer, which pads co-operate with a front-plane electrode on the other side of the liquid crystal layer to define an associated co-ordinate array of pixels within the liquid crystal layer to define an associated co-ordinate array of pixels within the liquid crystal layer, wherein each time the pixels of the co-ordinate array are refreshed, such refreshing is performed in two sequential stages that co-operate to preserve charge balance across each individual pixel of the array, in one of which stages the pixels have potential differences applied across them to set them into their required states and in the other of which the same individual potential differences are applied across the same individual pixels, but with the direction of application reversed.

3. A method as claimed in claim 1 wherein each of said stages of refreshing includes accessing the rows of pixels on a row sequential basis.

4. A method as claimed in claim 2 wherein each of said stages of refreshing includes accessing the rows of pixels on a row sequential basis.

* * * * *